US007475835B2

(12) United States Patent
Kettunen

(10) Patent No.: US 7,475,835 B2
(45) Date of Patent: Jan. 13, 2009

(54) METHOD AND APPARATUS FOR TRANSFERRING AND COLLECTING WASTE MATERIAL

(75) Inventor: Timo Kettunen, Espoo (FI)

(73) Assignee: Marimatic Oy, Vantaa (FI)

( * ) Notice: Subject to any disclaimer, the term of this patent is extended or adjusted under 35 U.S.C. 154(b) by 294 days.

(21) Appl. No.: 11/084,074

(22) Filed: Mar. 18, 2005

(65) Prior Publication Data

US 2006/0207653 A1 Sep. 21, 2006

(30) Foreign Application Priority Data

Mar. 17, 2005 (FI) ..... 20055122

(51) Int. Cl.
*B02C 1/00* (2006.01)
*B02C 13/00* (2006.01)

(52) U.S. Cl. ..... 241/21; 241/185.6

(58) Field of Classification Search ..... 241/21, 241/38, 185.6; 137/565.17
See application file for complete search history.

(56) References Cited

U.S. PATENT DOCUMENTS 4,054,519 A * 10/1977 Tufts ..... 210/104
4,319,366 A 3/1982 Baker, Jr. et al.
4,516,281 A * 5/1985 MacPherson et al. ..... 4/319
4,819,279 A * 4/1989 Sigler et al. ..... 4/300
5,681,148 A 10/1997 Friedman et al.

FOREIGN PATENT DOCUMENTS

GB 1 364 474 8/1974
JP 2004-50058 2/2004

* cited by examiner

*Primary Examiner*—Faye Francis
(74) *Attorney, Agent, or Firm*—Ladas & Parry LLP

(57) ABSTRACT

A method for transferring and collecting waste material, especially food waste, in which method the s waste material is transferred in a pipe system (7) portion-like from a feed station (1) to a collecting tank (9) and possibly onwards to further processing, Waste material is transferred in the pipe system with a pump device (8) which is arranged to the pipe system (7) between the feed station and the collecting tank, in which case the waste material passes through the pump (8).

12 Claims, 1 Drawing Sheet

METHOD AND APPARATUS FOR TRANSFERRING AND COLLECTING WASTE MATERIAL

BACKGROUND OF THE INVENTION

The present invention relates to a method for transferring and collecting waste material, especially food waste, in which method the waste material is transferred in a pipe system portion-like from a feed station to a collecting tank and possibly onwards to further processing.

The invention also relates to an apparatus for transferring and collecting food waste, which apparatus comprises at least one feed station, collecting tank, pipe system between the feed station and the collecting tank, and pump device for waste material, such as food waste.

It is known to transfer foodstuffs and their waste in pipe systems by means of a pressure difference. Also known from ships are gravity collecting systems of food waste, In these, waste material, such as food waste, from a waste collecting point is lead to a pipe system through a grinder, and, at the same time, a lot of water is added to the waste. Typically, these systems have structural limitations. The pipe system has to be as straight as possible, and the pipe diameters are large. In spite of this, clogging risks are great. All these factors together make the design and installation of the system in question difficult, especially for ship use in which the allowed use of space for the apparatus and the pipe system is extremely limited. Also known are vacuum transfer systems, especially intended for large ships, such as cruise ships, in which systems the suction of the pipe system is achieved with ejector apparatuses. These are usually unsuitable for the transfer and collection of food waste in small ships.

The object of this invention is to achieve a totally novel solution for the transfer and collection of food waste especially in smallish ships, with which solution the disadvantages of known solutions are avoided. The object of the invention is thus to accomplish a method and an apparatus, which system may be easily implemented and which has low installation and operating costs.

BRIEF DESCRIPTION OF THE INVENTION

Mainly characteristic for a method according to the invention is that waste material, such as food waste, is transferred in a pipe system with a pump device which is arranged to the pipe system between a feed station and a collecting tank, in which case the waste material, such as food waste, passes through the pump.

The waste material, such as food waste, may be grinded, advantageously in the feed unit, before transferring it to the collecting tank. The liquid may be added to the waste material before the transferring from the feed unit to the collecting tank.

The method may also be characterized by, when transferring waste material, first starting up the pump unit and opening a first in-line valve possible at least in systems with many feed stations, when the waste material transfers from the feed station along a pipe through the pipe to the collecting tank.

The method may also be characterized by, when transferring the waste material to further processing from the collecting tank to an outlet pipe, using the same pump device for emptying by operating it in the reverse direction.

The method may also be characterized by, when transferring the waste material to further processing from the collecting tank to the outlet pipe, closing a second line value of the pipe system, opening a line valve of the outlet pipe, and using the pump device in the reverse direction to accomplish the emptying of the waste material from the collecting tank.

Characteristic for an apparatus according to the invention is that a pump device is arranged to a pipe between a feed station and a collecting tank so that waste material, such as food waste, passes through the pump to the collecting tank when transferring food waste from the feed station to the collecting tank.

The apparatus may comprise an outlet pipe which is arranged to the pipe system to the opposite side of the pump with regard to the collecting tank, and a second line valve, in which case the collecting tank may be emptied through the outlet pipe by using the pump in the reverse direction.

The feed unit may comprise a macerator for waste material, such as food waste. The pump device may be a pump achieving at least a partial vacuum in the suction side, most suitably, a so-called lobe rotor pump. A line valve may be arranged to the pipe system at least in an apparatus comprising many feed stations for opening and closing the connection between each feed station and the collecting tank.

A solution according to the invention has many significant advantages. Compared to gravity systems, the method and the apparatus enable flexibility from the viewpoint of pipe-line design and installation. The system does not require a separate pump for emptying the collecting tank, but for transferring food waste, that is, for producing a vacuum and emptying the collecting tank, the same pump device may be used. In the system, water to be added to the waste material, such as food waste, is saved considerably, even 50%, compared to the gravity system. In addition, pipe sizes may be smaller by their diameters. The system is most suited for ships, such as cargo ships, yachts, merchant ships and warships, in which the production of waste material, such as food waste, is relatively small.

BRIEF DESCRIPTION OF THE FIGURES

Next, the invention is described in more detail by means of an example by referring to the accompanying drawing in which.

DETAILED DESCRIPTION OF THE INVENTION

Figure 1:
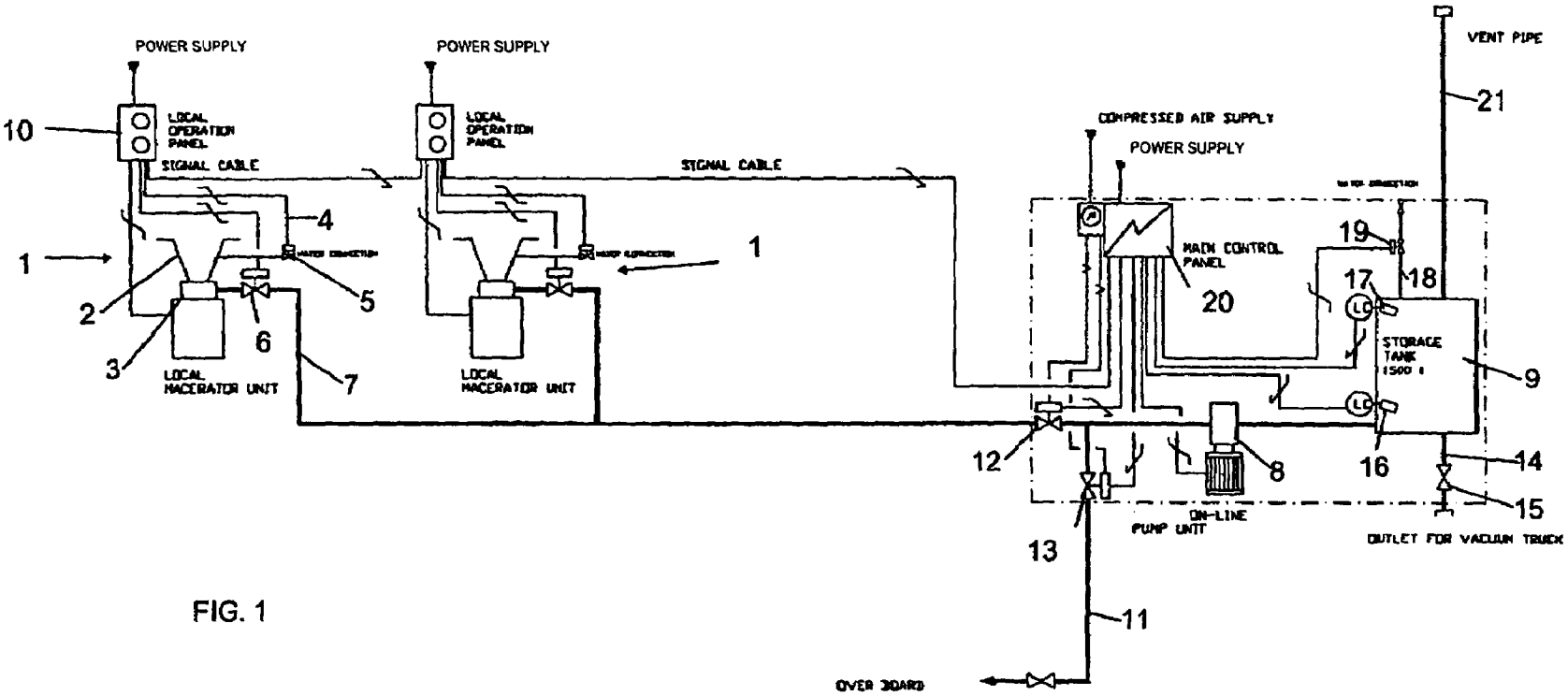
FIG. 1 shows an apparatus according to the invention as a diagram.

FIG. 1 shows a transfer and collection system according to the invention for waste material, such as food waste, as a diagram. The system comprises at least one feed station 1, for example, for receiving food waste accumulating in a ship kitchen. There are typically many feed stations. The FIGURE shows two feed stations 1. In the following, only the operation of one feed station is described. In the embodiment of the FIGURE, the feed station 1 comprises a feed funnel 2, in connection with which, typically below it, is arranged a macerator 3 for grinding waste material, such as food waste. The form of the feed funnel is advantageously conical. In connection with the feed funnel 2, also pieces of equipment 4, 5 for feeding water or other liquid to the feed funnel 2 are arranged. The feed station 1 is connected to a transfer pipe 7 through which the grinded waste material, such as food waste, is transferred with a pump device 8 from the feed station 1 to a collecting tank 9. The pump device 8 is arranged to the transfer pipe 7 between the feed station 1 and the collecting tank 9, in which case the transferred waste material, such as food waste, passes through the pump 8 from the feed station 1 to the collecting tank 9. In connection with the feed station, a first line valve 6 is arranged to the feed pipe 7, which valve is controlled so that, when transferring waste material, such as food waste, from the feed station, it is open, and when food waste is not transferred, it is closed. Typically, each feed station 1 has its own line valve 6 in its vicinity. In connection with the feed station, a local control unit 10 is arranged which unit communicates with a main control unit 20. The user of the feed station controls typically the operation of the feed station and typically also the whole apparatus by means of the local control unit. The user or, for example, an automatic timer starts the feed station 1 when there is a suitable amount of waste material, such as food waste, in the feed funnel. The control units 10, 20 control the operation of the system either automatically or according to the commands given by the user, inter alia, by opening and closing valves and by using the pump device according to a preset program or when required. On the ship, the feed stations 1 may be located on decks located in different tiers. The collecting tank 9, the pump device 8 and the main control unit 20 are advantageously arranged as one assembly, advantageously as a module, which is described with a dash line in the FIGURE. In the FIGURE, the control units are connected to each other with a signal cable, but also other data-transmitting arrangements are possible.

In the FIGURE, the pump device 8 is arranged to the pipe system 7 between the feed stations 1 and the collecting tank 9, typically in the vicinity of the collecting tank 9. The pump achieves a vacuum to the pipe system to the suction side. The pump 8 is advantageously a so-called lobe rotor pump. The pumping direction of the pump may be reversed, in which case the same pump 8 may be used for both transferring food waste to the collecting tank 9 and for emptying the collecting tank through an outlet pipe 11. The pump 8 is thus arranged to the pipe system 7 between the collecting tank and the outlet pipe. The outlet pipe 11 is thus typically connected to the pipe system 7 between the feed stations 1 and the pump 8, typically in the vicinity of the pump device 8. The vacuum achieved by the pump 8 enables transferring waste material, such as food waste, in the pipe system 7, even though the pipe system would sometimes run upwards or to various directions. In the FIGURE, the pipe system 7 is described as a diagram, and the actual directions are not shown in the diagram, but are dependent on the target of application.

The collecting tank has advantageously a second outlet pipe 14, for example, for emptying the collecting tank to another tank, such as a waste tank truck. The second outlet pipe is provided with a valve member 15. The collecting tank 9 has also a ventilating pipe 21.

The system according to the FIGURE operates in the following way. The waste material to be transferred, such as food waste, is placed in the feed funnel 2, and the user activates an operation from the local control unit 10, for example, from a push button. Then, the macerator 3 starts up, and, with the liquid-adding equipment 4, 5, liquid is brought to the grinded material. After a set time, the vacuum pump 8 starts up, and the first line valve 6 opens, when the transfer of grinded waste material from the feed station 1 starts. The waste material, such as food waste, transfers from the feeding station 1 along the feed pipe 7 to the collecting tank 9.

From the collecting tank, it is possible to empty the waste material, such as food waste, by means of the pump device 8 to the outlet pipe 11. Then, the second line valve 12 is closed, and the outlet-line valve 13 is opened. The pump device 8 is now arranged to operate in the reverse direction, most suitably by changing the rotation direction, when waste material, such as food waste, transfers from the collecting tank 9 to the outlet pipe 11. The emptying of the collecting tank is performed, for example, on the basis of information given by limit sensors 16, 17 arranged to the tank and/or when chosen.

To the collecting tank is arranged a washing liquid fitting 18, especially a water fitting. Then, the washing of tank 9 is combined to the emptying of the tank. As the surface reaches the lower limit surface when emptying the tank, the wash-fitting valve 19 opens. When the tank is empty, the pump 8 stops. In connection with the washing of the tank, also the flushing of the pipe system, the pump and the outlet line 11 is typically arranged.

The invention thus relates to a method for transferring and collecting food waste, in which method the food waste is transferred in the pipe system 7 portion-like from the feed station 1 to the collecting tank 9 and possibly onwards to further processing. Waste material, such as food waste, is transferred in the pipe system with the pump device 8 which is arranged to the pipe system 7 between the feed station and the collecting tank, in which case the waste material, such as food waste, passes through the pump 8.

According to an advantageous embodiment, waste material, such as food waste, is grinded, advantageously in the feed unit 1, before transferring it to the collecting tank 9.

To the waste material, such as food waste, liquid is added before transferring it from the feed unit 1 to the collecting tank 9. When transferring food waste, first the pump unit 8 is started up, and a first line valve 6 possible at least in systems with many feed stations 1 is opened, when the waste material, such as food waste, transfers from the feed station 1 along the pipe 7 through the pump 8 to the collecting tank.

When transferring the waste material, such as food waste, to further processing or for removing it from the ship's collecting tank 9 to the outlet pipe 11, the same pump device 8 is used for emptying by operating it in the reverse direction.

When transferring waste material, such as food waste, to further processing from the collecting tank to the outlet pipe 11, the second line valve 12 of the pipe system 7 is closed, the line valve 13 of the outlet pipe 11 is opened, and the pump device is used in the reverse direction to accomplish the emptying of the waste material, such as food waste, from the collecting tank 9.

An apparatus for transferring and collecting waste material, such as food waste, which apparatus comprises at least one feed station 1, collecting tank 9, pipe-system 7 between the feed station 1 and the collecting tank 9, and pump device 8 for waste material, such as food waste. It is characteristic for the invention that the pump device 8 is arranged to the pipe 7 between the feed station 1 and the collecting tank 9 so that waste material, such as food waste, passes through the pump 8 to the collecting tank 9 when transferring waste material, such as food waste, from the feed station to the collecting tank.

According to an advantageous embodiment, the apparatus comprises an outlet pipe 11 which is arranged to the pipe system 7 to the opposite side of the pump 8 with regards to the collecting tank 9, and a second line valve 12, in which case the collecting tank may be emptied through the outlet pipe 11 by using the pump 8 in the reverse direction.

The feed station 1 comprises, according to an advantageous embodiment, a macerator 3 for waste material, such as food waste.

According to an advantageous embodiment of the invention, the pump device 8 is a pump achieving at least a partial vacuum in the suction side, most suitably a so-called lobe rotor pump.

At least in an apparatus comprising many feed stations 1, a line valve 6 is arranged to the pipe system 7 for opening and closing the connection between each feed station 1 and the collecting tank 9.

It is well known by those skilled in the art that the invention does not limit to the embodiments described above, but it may vary within the scope of the enclosed patent claims. If required, the characteristic features possibly described in this specification together with other characteristic features may also be used separate from each other. Instead of food waste, this apparatus and method may also be used for the transfer and treatment of other waste material, especially organic waste material.

The invention claimed is:

1. In a method of transferring portioned food waste material, the improvements comprising transferring the waste material in a pipe system (7) from a feed station (1) to a collecting tank (9) with a pump device (8) arranged to the pipe system (7) between the feed station and the collecting tank (9) by passing the waste material through the pump device (8) operating in a forward direction, and transferring the waste material from the collecting tank (9) to an outlet pipe (11) by operating the pump device (8) in a reverse direction, closing a line valve (12) of the pipe system (7) and opening a line valve (13) of the outlet pipe (11) between the pump device (8) and the line valve (12) of the pipe system (7) for emptying the collecting tank (9), wherein the pump device (8) achieves at least partial vacuum on a suction side in at least one of operating in the forward and reverse directions.

2. A method according to claim 1, wherein the waste material, such as food waste, is grinded, advantageously in the feed unit, before transferring it to the collecting tank (9).

3. A method according to claim 2, wherein liquid is added to the waste material before the transferring from the feed unit (1) to the collecting tank (9).

4. A method according to claim 2 wherein liquid is added to waste material, such as food waste, before transferring it from the feed unit (1) to the collecting tank.

5. A method according to claim 1, wherein liquid is added to the waste material before the transferring from the feed unit (1) to the collecting tank (9).

6. A method according to claim 1, characterised by, when starting up the pump unit (8) in the forward direction, opening a first in-line valve (6) along the pipe system (7) through the pump device (8) to the collecting tank.

7. A method according to claim 1, wherein the pump device (8) is a lobe rotor pump.

8. A method according to claim 1, wherein the waste material is grinded, advantageously in the feed unit, before transferring it to the collecting tank (9).

9. A method according to claim 1, wherein liquid is added to the waste material before transferring it from the feed unit (1) to the collecting tank (9).

10. A method according to claim 1, characterised by, when transferring waste material, such as food waste, first the pump unit is started up and, at least in systems with many feed stations, a first in-line valve (6) is opened and the waste material is transferred from the feed station (1) along a pipe (7) through the pump (8) to the collecting tank.

11. A method according to claim 1, wherein the pump device (8) achieving at least a partial vacuum in the suction side is a so-called lobe rotor pump.

12. A method for transferring and collecting waste material, from a food station (1) to a collecting tank (9) and onwards to further processing in a pipe system (7) with the pump device (8) arranged to the pipe system (7) between the feed station (1) and the collecting tank (9) wherein at least a partial vacuum is achieved to the pipe system in the suction side of a pump device and a portion of the food waste material is transferred in the pipe system from feed station (1) through the pump device (8) to the collecting tank (9) and wherein the food waste material is transferred to further processing from the collecting tank (9) to an outlet pipe (11) using the same pump device (8) for emptying by operating it in reverse direction and wherein a second line valve (12) of the line system is closed and a line valve (13) of the outlet pipe is opened.

* * * * *